United States Patent [19]

Maahs

[11] 3,979,575

[45] Sept. 7, 1976

[54] PORTABLE ELECTRIC OVEN

[75] Inventor: Werner H. Maahs, Milwaukee, Wis.

[73] Assignee: M & M Enterprises, Inc., Milwaukee, Wis.

[22] Filed: May 29, 1975

[21] Appl. No.: 581,786

[52] U.S. Cl. ..... 219/407; 219/424; 219/544

[51] Int. Cl.[2] ..... F27D 11/02

[58] Field of Search ..... 219/341, 406, 407, 424, 219/528, 544; 338/212

[56] References Cited

UNITED STATES PATENTS

| | | | |
|---|---|---|---|
| 1,581,259 | 4/1926 | Wiechert et al. | 219/407 |
| 2,505,117 | 4/1950 | Hoffmann | 219/407 X |
| 3,155,814 | 11/1964 | Appleman et a. | 219/407 |
| 3,268,846 | 8/1966 | Morey | 338/212 |
| 3,412,234 | 11/1968 | Otavka | 219/406 |
| 3,800,123 | 3/1974 | Maahs | 219/407 |

FOREIGN PATENTS OR APPLICATIONS

| | | | |
|---|---|---|---|
| 65,489 | 8/1913 | Switzerland | 219/407 |

*Primary Examiner*—Volodymyr Y. Mayewsky
*Attorney, Agent, or Firm*—Keith D. Beecher

[57] ABSTRACT

A portable and/or stationary electric oven in which the heating element takes the form of a silicone rubber sheet wrapped around the walls of the oven, and which includes nickel alloy electric heater wires embedded in the silicone rubber sheet.

2 Claims, 5 Drawing Figures

PORTABLE ELECTRIC OVEN

BACKGROUND OF THE INVENTION

The oven of the present invention may be of the same general type described in U.S. Pat. Nos. 3,521,030 and 3,800,123, which issued in the name of Jerry D. Maahs, and which are assigned to the present assignee. Specifically, the oven of the invention may be a cooking and holding oven such as described in the patents. However, the invention is not specifically limited to that type of oven.

Similar to the ovens described in the patents, the oven of the present invention includes one or more electric heater elements encased in the walls of the oven and which extend around the interior compartment thereof.

However, unlike the ovens described in the aforesaid patents, which include electric cables formed of electric resistance wires surrounded by a sheath of asbestos which in turn is surrounded by a glass braid and a monel metal outer covering; the oven of the present invention is of a simpler and more compact construction, in that bare electric heater wires are embedded in a sheet of silicone rubber, the sheet being wrapped around the oven compartment to constitute an electrically energized heat source for the oven.

DETAILED DESCRIPTION OF THE ILLUSTRATED EMBODIMENT

Figure 1:
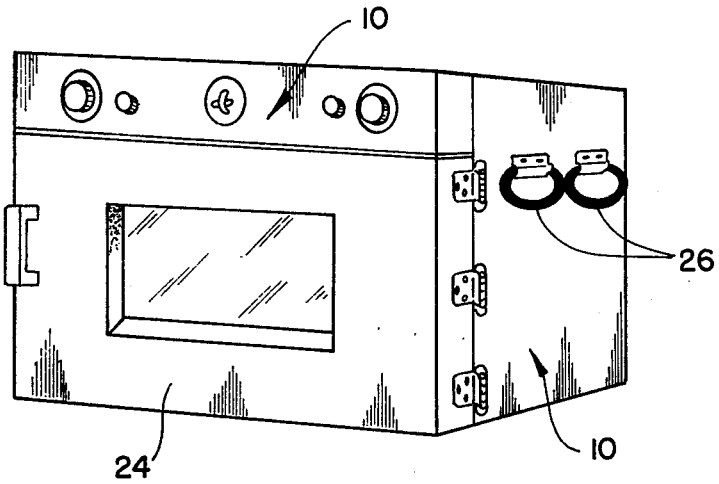
FIG. 1 is a perspective representation of a portable and/or stationary oven which may incorporate the heat source of the present invention.
Figure 2:
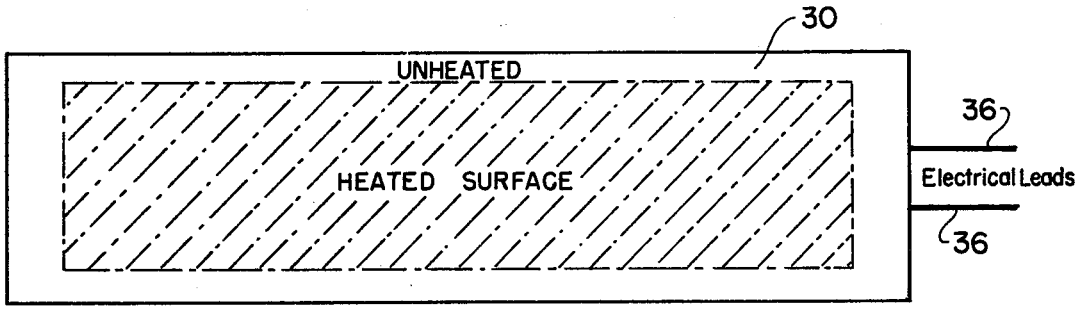
FIG. 2 is a top plan view of a silicone rubber sheet having internal electrically energized resistance wires formed, for example, of nickel alloy, and which is interposed between the walls of the unit of FIG. 1 to constitute the heating source for the oven.
Figure 3:
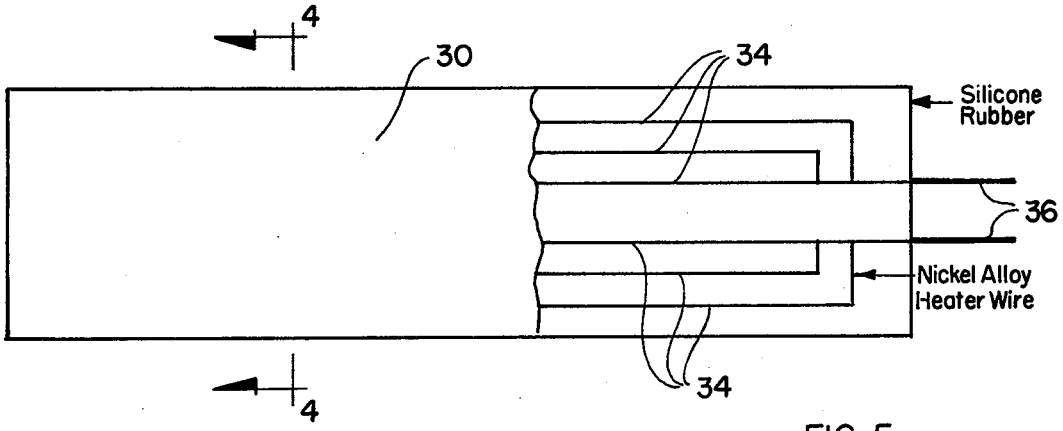
FIG. 3 is a view, like FIG. 2, but with a portion of the sheet broken away to reveal the internal heater wires.
Figure 4:
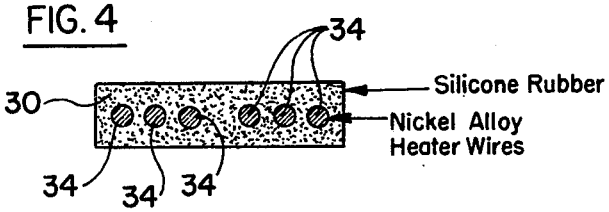
FIG. 4 is a cross-sectional view of the sheet of FIG. 3 taken essentially along the line 4—4 of FIG. 3.

The oven unit shown in FIG. 1 is designated generally as 10 and, in the illustrated embodiment, it has a solid rectangular configuration. Within the oven 10 is a food compartment 12 (FIG. 5) formed of inside shell walls 14, 16, 18, 20 and 22, and by a hinged door 24. The oven may also be equipped with handles such as the handles 26 to permit the user to move the unit from place to place.

Figure 5:
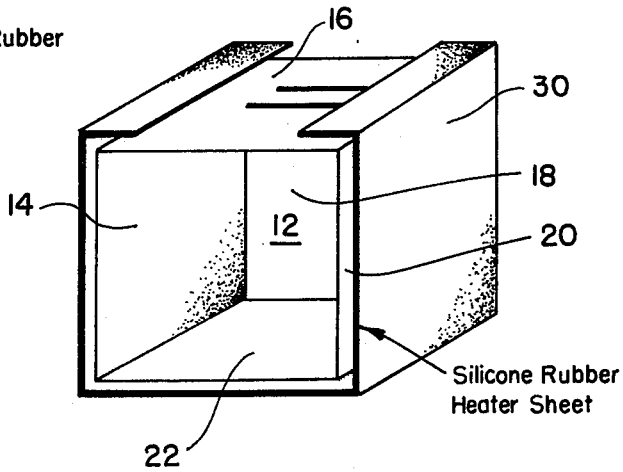
FIG. 5 is a somewhat schematic perspective representation showing the manner in which the silicone rubber sheet of FIGS. 2–4 is wrapped around the inner compartment of the oven unit of FIG. 1.

A heater sheet 30 of silicone rubber is wrapped around the walls of the unit, as shown in FIG. 5, so as to constitute an electrically energized heat source for the oven. This heater sheet may be of the type manufactured by Watlow Electric Manufacturing Company, 12001 Lackland Road, St. Louis, Missouri 63141.

A plurality of bare nickel alloy electrically resistance heater wires 34 are embedded in the sheet 30, and electrical energy is fed to the wires by appropriate electric leads 36. The electric leads 36 connect the oven to an appropriate control circuit and electrical energizing source, such as described, for example, in the aforesaid patents. The wires 34 may be formed by spiralling one or more fine nickel wires around a glass cord.

The silicone rubber heater sheet forms an effective heat source for the oven, and provides a simple means whereby the oven may be constructed.

It will be appreciated that although a particular embodiment of the invention has been shown and described, modifications may be made. It is intended in the claims to cover the modifications which come within the spirit and scope of the invention.

What is claimed is:

1. An electric oven comprising: a plurality of external wall members; a plurality of internal wall members forming an internal oven compartment; a door closing said oven compartment; a sheet of insulating material formed of silicone rubber wrapped around the internal wall members having a width corresponding substantially to the width of the wall members of the internal wall members and extending as a single layer substantially around the internal wall members forming the oven compartment between the internal and external wall members; and bare electrical resistance wires embedded in the silicone rubber sheet and around said internal wall members and having electrical leads for connection to an electrical energizing source for heating the oven compartment.

2. The electric oven defined in claim 1, in which the wires are formed of nickel alloy.

* * * * *